US009147381B2

(12) United States Patent
Dlugasz

(10) Patent No.: US 9,147,381 B2
(45) Date of Patent: Sep. 29, 2015

(54) TUBULAR NECK FOR A STRINGED INSTRUMENT

(71) Applicant: Timothy Dlugasz, Sterling, MA (US)

(72) Inventor: Timothy Dlugasz, Sterling, MA (US)

( * ) Notice: Subject to any disclaimer, the term of this patent is extended or adjusted under 35 U.S.C. 154(b) by 0 days.

(21) Appl. No.: 14/057,397

(22) Filed: Oct. 18, 2013

(65) Prior Publication Data

US 2014/0109746 A1 Apr. 24, 2014

Related U.S. Application Data

(60) Provisional application No. 61/716,751, filed on Oct. 22, 2012.

(51) Int. Cl.
*G10D 3/02* (2006.01)
*G10D 3/06* (2006.01)

(52) U.S. Cl.
CPC ..... *G10D 3/06* (2013.01)

(58) Field of Classification Search
USPC ..... 84/294
See application file for complete search history.

(56) References Cited

U.S. PATENT DOCUMENTS

| | | | | |
|---|---|---|---|---|
| 4,079,652 | A * | 3/1978 | Gittler | 84/743 |
| 4,637,290 | A * | 1/1987 | Grawi | 84/173 |
| 4,681,009 | A * | 7/1987 | Mouradian | 84/293 |
| 7,465,870 | B1 * | 12/2008 | Homan | 84/743 |
| 7,531,729 | B1 * | 5/2009 | Davis et al. | 84/293 |
| 7,659,464 | B1 * | 2/2010 | Kokodis | 84/293 |
| 2008/0156168 | A1 * | 7/2008 | Luttwak | 84/267 |
| 2012/0192698 | A1 * | 8/2012 | Allred et al. | 84/293 |

* cited by examiner

*Primary Examiner* — Christopher Uhlir
(74) *Attorney, Agent, or Firm* — Anderson Gorecki & Rouille LLP

(57) ABSTRACT

A tubular neck for a stringed instrument is disclosed. The neck includes at least one sound tube having a first end and a second end. The neck further includes at least one resonator tube having a first end and a second end, the at least one resonator tube in mechanical communication with the at least one sound tube wherein said first end of the at least one sound tube overlaps a first end of the at least one resonator tube.

16 Claims, 9 Drawing Sheets

TUBULAR NECK FOR A STRINGED INSTRUMENT

CROSS REFERENCE TO RELATED APPLICATIONS

The present application claims the benefit of U.S. Provisional Patent Application No. 61/716,751, filed on Oct. 22, 2012, which is incorporated herein by reference in its entirety.

BACKGROUND

Stringed instruments such as guitars, violins, mandolins, ukuleles and the like are well known. A guitar is a plucked string instrument, usually played with fingers or a pick. A typical guitar (or other stringed instrument) includes a body with a rigid neck, to which the strings, generally six in number, are attached. Guitars are traditionally constructed of various woods and strung with either nylon or steel strings. There are two primary families of guitars: acoustic and electric.

Acoustic guitars (and similar instruments) with hollow bodies have been in use for over a thousand years. There are three main types of modern acoustic guitar: the classical guitar (nylon-string guitar), the steel-string acoustic guitar, and the arch top guitar. The tone of an acoustic guitar is produced by the vibration of the strings, which is amplified by the body of the guitar, which acts as a resonating chamber. Electric guitars, introduced in the 1930s, rely on an amplifier that can electronically manipulate tone. Early amplified guitars employed a hollow body, but a solid body was found more suitable.

SUMMARY

Conventional stringed instruments, such as those explained above suffer from a variety of deficiencies. One such deficiency is that they include a wooden neck which has a first end attached to the body and the second end attached to a peg head (also referred to herein as a headstock) which has a tuner for each string mounted thereon. The wooden neck can break, warp, change in size due to humidity or dryness, and has a certain thermal coefficient of expansion which may not match the thermal coefficients of expansion of the guitar body and/or the peg head. This can lead to the stringed instrument getting out of tune or even suffering mechanical failure. Embodiments of the invention significantly overcome such deficiencies Note that each of the different features, techniques, configurations, etc. discussed in this disclosure can be executed independently or in combination. Accordingly, the present invention can be embodied and viewed in many different ways. Also, note that this summary section herein does not specify every embodiment and/or incrementally novel aspect of the present disclosure or claimed invention. Instead, this summary only provides a preliminary discussion of different embodiments and corresponding points of novelty over conventional techniques. For additional details, elements, and/or possible perspectives (permutations) of the invention, the reader is directed to the Detailed Description section and corresponding figures of the present disclosure as further discussed below.

BRIEF DESCRIPTION OF THE DRAWINGS

The foregoing will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention. The drawings are not necessarily to scale, emphasis instead being placed upon illustrating the principles of the invention.

DETAILED DESCRIPTION

The embodiments set forth below represent the necessary information to enable those skilled in the art to practice the invention and illustrate the best mode of practicing embodiments of the invention. Upon reading the following description in light of the accompanying figures, those skilled in the art will understand the concepts of the invention and recognize applications of these concepts not particularly addressed herein. It should be understood that these concepts and applications fall within the scope of the disclosure and the accompanying claims.

A tubular neck for a stringed instrument is presented. While the present invention is applicable to all types of stringed instruments, it is described with respect to a guitar but in no manner should be limited to only guitars. A guitar neck is made up of at least one tube. While any number of tubes could be used, the present invention is described in relation to a particular embodiment having a pair of tubes. The word guitar is used herein to refer to any stringed instrument.

Figure 1:
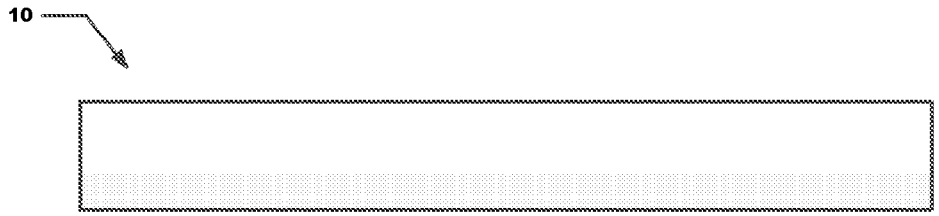
FIG. 1 depicts a side view of a sound tube in accordance with a particular embodiment of the present invention.
Figure 2A:
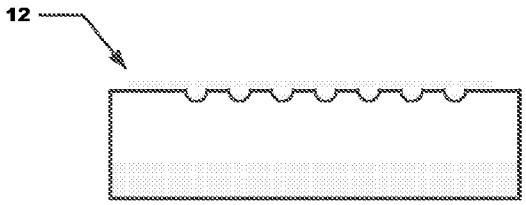
FIG. 2A depicts a side view of first embodiment of a resonator tube in accordance with a particular embodiment of the present invention.
Figure 2B:
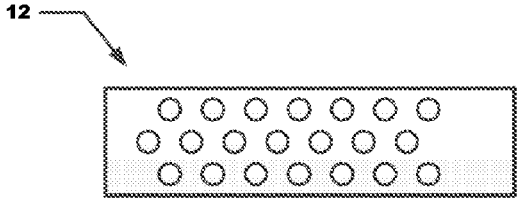
FIG. 2B depicts a side view of a second embodiment of a resonator tube in accordance with a particular embodiment of the present invention.

Referring to FIGS. 1, 2A and 2B pieces of a tubular guitar neck are shown. The guitar neck includes at least one sound tube 10. While a tube having a circular cross-section is shown and described, any shaped tube could be utilized. In the described embodiment the guitar neck is comprised of a pair of sound tubes 10 joined to a pair of resonator tubes 12. In certain embodiments the resonator tubes have a plurality of holes extending through a surface of the resonator tube 12 while other embodiments do not use holes in the resonator tube. When holes are used in the resonator tube, the size of the holes, the number of holes and the spacing of the holes in the resonator tube 12 provide for different variations and amounts of resonance.

Figure 3A:
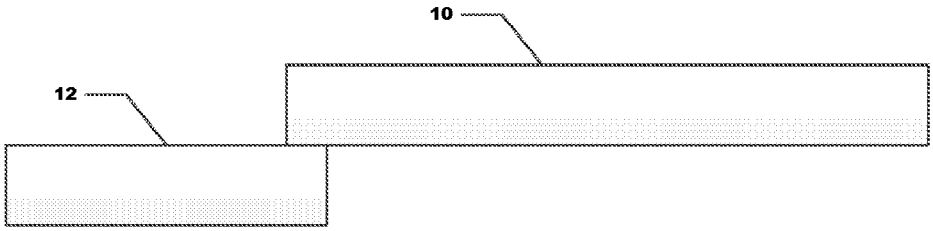
FIG. 3A depicts a side view of a sound tube attached to a resonator tube in accordance with a particular embodiment of the present invention.
Figure 3B:
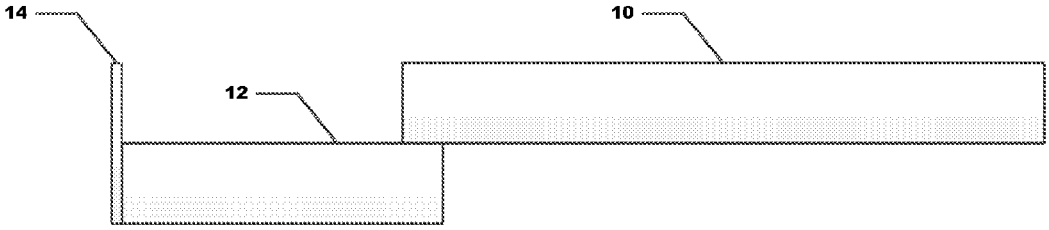
FIG. 3B depicts a side view of sound tube attached to a resonator tube and including a strength plate in accordance with a particular embodiment of the present invention.

As shown in FIGS. 3A and 3B, the sound tubes 10 are in mechanical communication with the resonator tubes 12 in an overlapping arrangement. In a particular embodiment two sound tubes are joined together along their length, as are two resonator tubes. This may be accomplished by welding, soldering, or other such attachment means as would be known by one of ordinary skill in the art. The set of sound tubes are also welded, soldered or attached by similar means to the resonator tubes creating an overlap area. FIG. 3B also shows a stop plate affixed to a distal end of the resonator tubes.

Figure 4A:
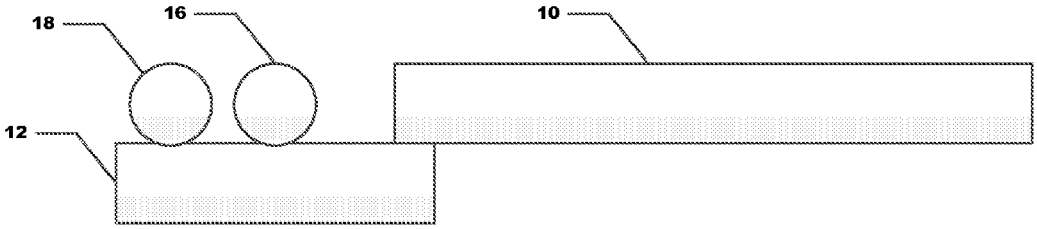
FIG. 4A depicts a side view of a sound tube attached to a resonator tube and including a bridge support and a stop tailpiece in accordance with a particular embodiment of the present invention.
Figure 4B:
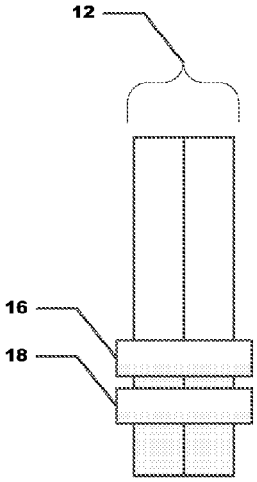
FIG. 4B depicts a top view of the hollow guitar piece of FIG. 4A in accordance with a particular embodiment of the present invention.

Referring now to FIGS. 4A and 4B, the tubular guitar neck is shown including a bridge support 16 and a stop tailpiece 18 disposed on the resonator tubes. Both the bridge support and the stop tailpiece are shown as circular tubes; however any shaped piece could be used.

Figure 5A:
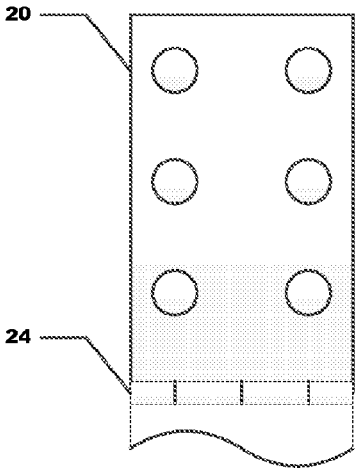
FIG. 5A shows a peg head connected to a hollow guitar piece in accordance with a particular embodiment of the present invention.
Figure 5B:
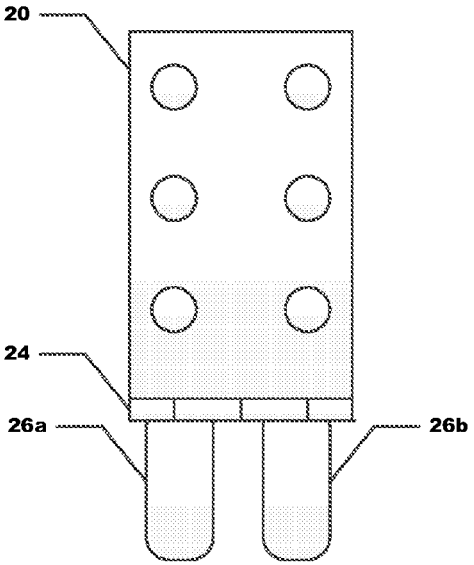
FIG. 5B shows a peg head having extension pieces for connecting to a hollow guitar piece in accordance with a particular embodiment of the present invention.

FIGS. 5A and 5B show a peg head 20. Peg head 20 is attached to the sound tubes and includes a plurality of tuners, one for each string. The tuners are used to adjust the tension on the string. As shown in FIG. 5B, the peg head includes a pair of extensions 26*a* and 26*b* that fit into the open end of the sound tubes of the tubular neck. The peg head also includes a nut 24. The peg head may be removably attachable to the sound tubes or can be integrated with the sound tubes.

Figure 6:
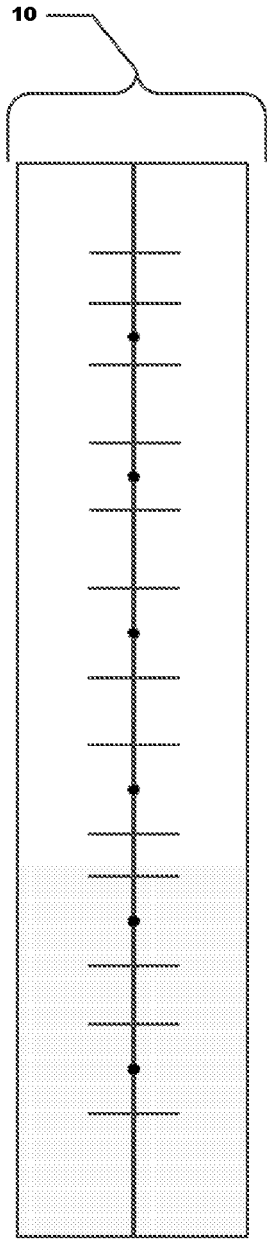
FIG. 6 depicts a rear view of a hollow body guitar piece having fret markers in accordance with a particular embodiment of the present invention.

FIG. 6 shows a rear view of the tubular neck 10. In this example, the two sound tubes also include a set of fret markings providing a physical indication of the locations of frets on the fret board (not shown) attached to the opposite surface of the sound tubes. This allows for blind fret recognition which allows the player to know where the frets are with the feel of the thumb. When the tubes have a circular cross-section, the joint where the two tubes attach provides a recess useful for better hand and thumb positioning form.

Figure 7:
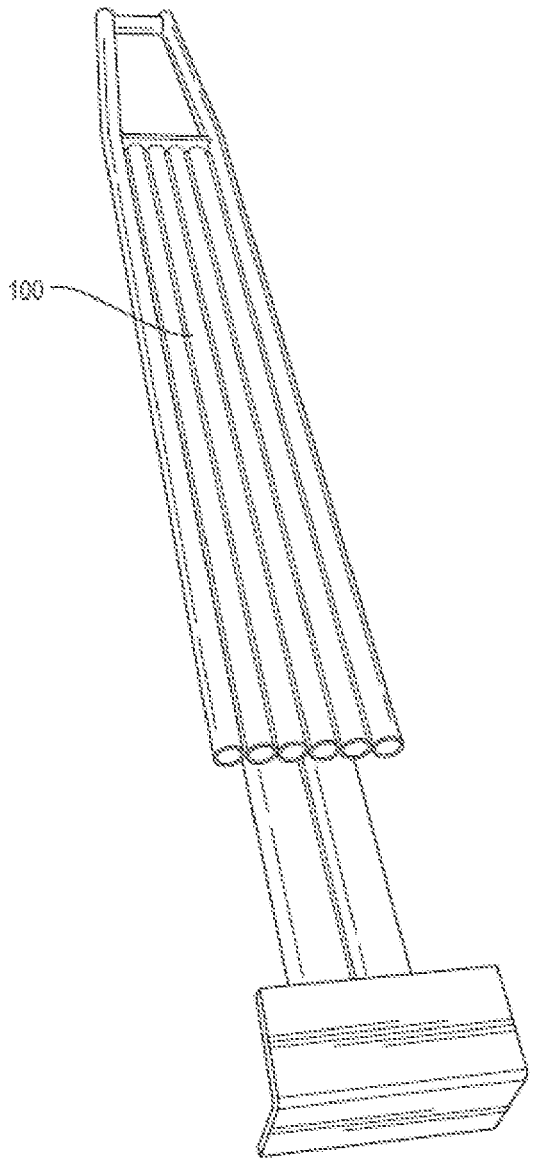
FIG. 7 depicts a view of a one piece neck and headstock in accordance with a particular embodiment of the present invention.
Figure 8:
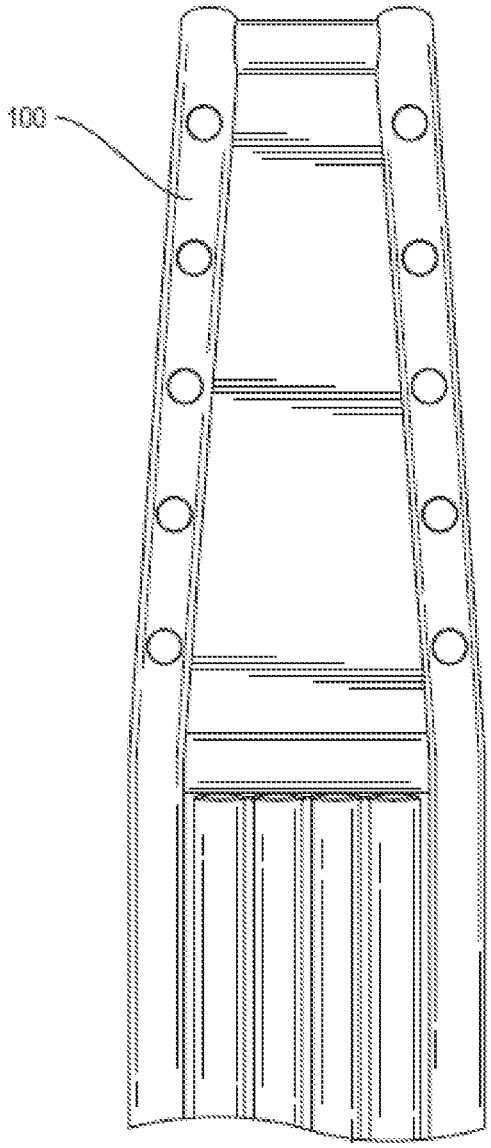
FIG. 8 depicts a view of the headstock of the one piece neck and headstock in accordance with a particular embodiment of the present invention.

FIG. 7 shows a one piece neck and headstock in accordance with a particular embodiment of the present invention. FIG. 8 depicts a view of the headstock of the one piece neck and headstock of FIG. 7.

Figure 9A:
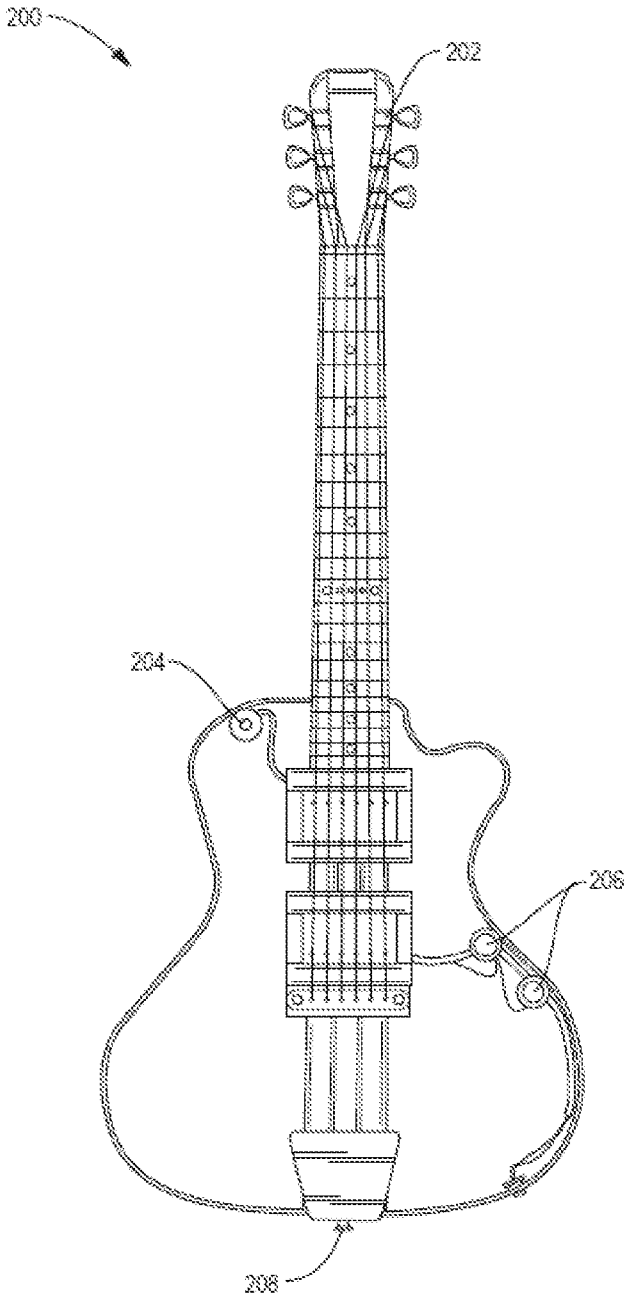
FIG. 9A shows a front view of a completed stringed instrument having a tubular neck in accordance with embodiments of the present invention.
Figure 9B:
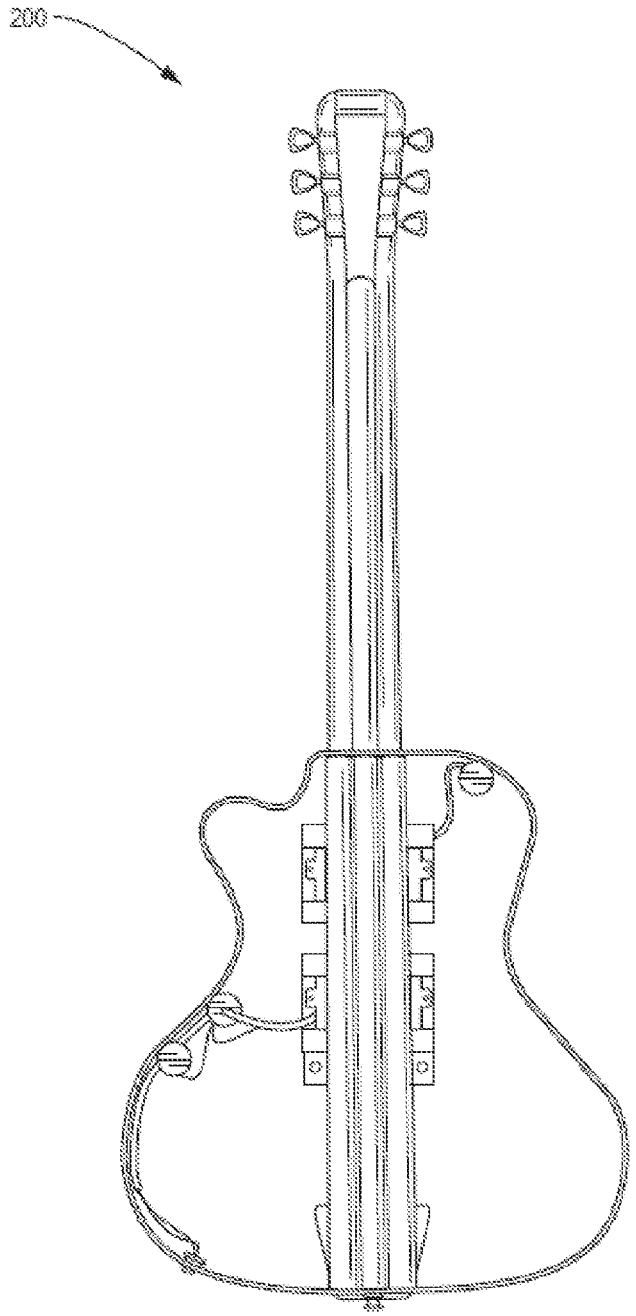
FIG. 9B shows a rear view of the completed stringed instrument of FIG. 9A in accordance with embodiments of the present invention.

Referring now to FIGS. 9A and 9B, a completed stringed instrument having a tubular neck 200 is shown. In this example the stringed instrument comprises a guitar. Guitar 200 includes a one-piece neck and headstock 202. Also shown are a floating 3-way switch 204, floating potentiometers 206 and a tail piece (non-stop) 208.

By way of the present invention, guitar and other string instrument frame uses welds or solders to create a neck to body joint which allows for a smaller body frame, while still maintaining a standard size neck and fret board as well as a higher reach for hard to reach frets. This body size and neck joint allows for more possible frets than standard stringed instruments.

The tubular frame design allows for more resonance and sound travel by providing a hollow resonant neck with resonating open hole or solid body tubes. The bridge and tailpiece are attached using solder and/or welds which creates a much stronger bond than that of wood allowing for greater weather/climate change resistance. Additionally, the truss rod element found in most guitars and stringed instruments is eliminated.

The peg head (also referred to as a headstock) used on the neck can be soldered, welded, or glued to allow for easy repair or replacement while also creating strength for string tension.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" or "an" to modify a noun may be understood to be used for convenience and to include one, or more than one of the modified noun, unless otherwise specifically stated.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

Having described preferred embodiments of the invention it will now become apparent to those of ordinary skill in the art that other embodiments incorporating these concepts may be used. Accordingly, it is submitted that that the invention should not be limited to the described embodiments but rather should be limited only by the spirit and scope of the appended claims.

What is claimed is:

1. A stringed instrument neck comprising:

at least one sound tube having a first end and a second end; and at least one resonator tube having a first end and a second end, said at least one resonator tube in direct mechanical communication with said at least one sound tube wherein said first end of said at least one sound tube overlaps a first end of said at least one resonator tube and wherein the remainder of said at least one sound tube extends beyond and away from said at least one resonator tube.

2. The stringed instrument neck of claim 1 wherein said at least one resonator tube includes at least one resonator hole disposed through a surface thereof.

3. The stringed instrument neck of claim 1 further comprising a stop plate affixed to a second end of said at least one resonator tube.

4. The stringed instrument neck of claim 1 further comprising a bridge support disposed on said at least one resonator tube.

5. The stringed instrument neck of claim 1 further comprising a stop tailpiece disposed on said at least one resonator tube.

6. The stringed instrument neck of claim 1 further comprising a plurality of fret markings disposed on a surface of said at least one sound tube.

7. The stringed instrument neck of claim 1 wherein said at least one sound tube comprises at least two sound tubes and wherein one of said at least two sound tubes is in mechanical communication along a length thereof with a second sound tube of said at least two sound tubes.

8. The stringed instrument neck of claim 1 wherein said at least one resonator tube comprises at least two resonator tubes and wherein one of said at least two resonator tubes is in mechanical communication along a length thereof with a second resonator tube of said at least two resonator tubes.

9. The stringed instrument neck of claim 7 further comprising a partial recess between adjacent ones of said sound tubes.

10. The stringed instrument neck of claim 1 further comprising a headstock in mechanical communication with said second end of said at least one sound tube.

11. The stringed instrument neck of claim 10 wherein said headstock is removably attachable to said second end of said at least one sound tube.

12. The stringed instrument neck of claim 10 wherein said headstock is integral with said second end of said at least one sound tube.

13. The stringed instrument neck of claim 1 wherein at least one of said at least one sound tubes has a circular cross-section.

14. The stringed instrument neck of claim 1 wherein at least one of said at least one resonator tubes has a circular cross-section.

15. The stringed instrument neck of claim 1 wherein at least one of said at least one sound tubes has a non-circular cross-section.

16. The stringed instrument neck of claim 1 wherein at least one of said at least one resonator tubes has a non-circular cross-section.

* * * * *